US008056590B2

(12) United States Patent
Liu

(10) Patent No.: US 8,056,590 B2
(45) Date of Patent: Nov. 15, 2011

(54) WOODWORKING MACHINE WITH ADJUSTMENT UNIT

(76) Inventor: James Liu, Taichung Hsien (TW)

( * ) Notice: Subject to any disclaimer, the term of this patent is extended or adjusted under 35 U.S.C. 154(b) by 257 days.

(21) Appl. No.: 12/563,208

(22) Filed: Sep. 21, 2009

(65) Prior Publication Data

US 2011/0067783 A1 Mar. 24, 2011

(51) Int. Cl.
*B25H 1/18* (2006.01)

(52) U.S. Cl. ..... 144/287; 83/471

(58) Field of Classification Search ..... 144/286.1–287; 83/469, 471, 474, 477.2
See application file for complete search history.

(56) References Cited

U.S. PATENT DOCUMENTS 6,508,281 B1 * 1/2003 Wang ..... 144/287
6,619,348 B2 * 9/2003 Wang ..... 144/287

* cited by examiner

*Primary Examiner* — Shelley Self
(74) *Attorney, Agent, or Firm* — Alan Kamrath; Kamrath & Associates PA

(57) ABSTRACT

An adjustment unit is installed to a woodworking machine including a base member and an auxiliary platform and is provided between the base member and the auxiliary platform. The adjustment unit includes an adjustment element including an operated portion formed on an end thereof and an adjustment portion formed on another end thereof. A first connective element includes a longitudinal first connective portion coupled to the adjustment portion of the adjustment element and a second connective element coupled to the first connective element and driving the operated portion of the adjustment element to adjust a horizontal position of the auxiliary platform.

13 Claims, 12 Drawing Sheets

WOODWORKING MACHINE WITH ADJUSTMENT UNIT

BACKGROUND OF THE INVENTION

1. Field of the Invention

The present invention relates to a woodworking machine and more particularly, to a woodworking machine with an adjustment unit adapted for adjusting a horizontal position of a platform of the woodworking machine.

2. Description of the Related Art

A conventional woodworking machine includes a working platform, and operators would put material to be processed on the working platform for cutting or planning. However, the fixed-size working platform could not apply to a variety of sizes of material to be processed, and an additional auxiliary platform is needed. To prevent a problem of delivery of a woodworking machine with huge volume, the auxiliary platform should be self-made to install to the original working platform, so that correction of a horizontal position of the auxiliary platform becomes more of a problem.

SUMMARY OF THE INVENTION

Accordingly, the object is achieved by providing a woodworking machine that comprises a base member, a primary platform, at least one of auxiliary platforms and a plurality of adjustment units provided between the auxiliary platforms and the base member. The auxiliary platforms can be added according to users' needs of sizes of the work plane of the woodworking machine. Also, a horizontal position of each auxiliary platform can be adjusted by users freely. A tightening element would be tightened to tighteningly abut with an adjustment element and prevent the adjustment element moving axially with respect to the first connective element. Therefore, the adjustment element is positioned.

Other advantages and features of the present invention will become apparent from the following descriptions referring to the drawings.

DETAILED DESCRIPTION OF THE PREFERRED EMBODIMENTS

Figure 1:
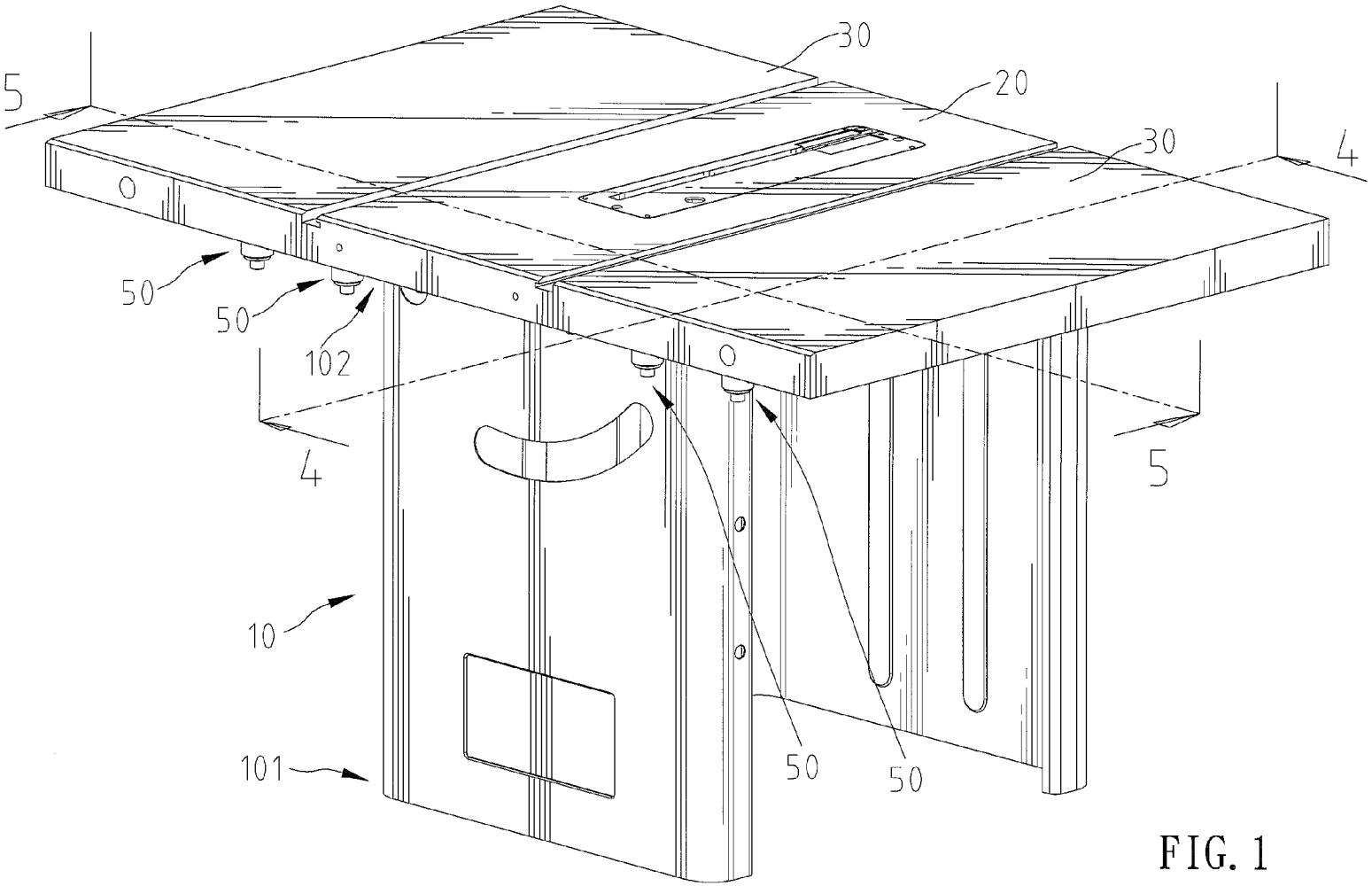
FIG. 1 is a perspective view of a woodworking machine with a horizontal positions adjustment unit according to a first embodiment of the present invention.
Figure 2:
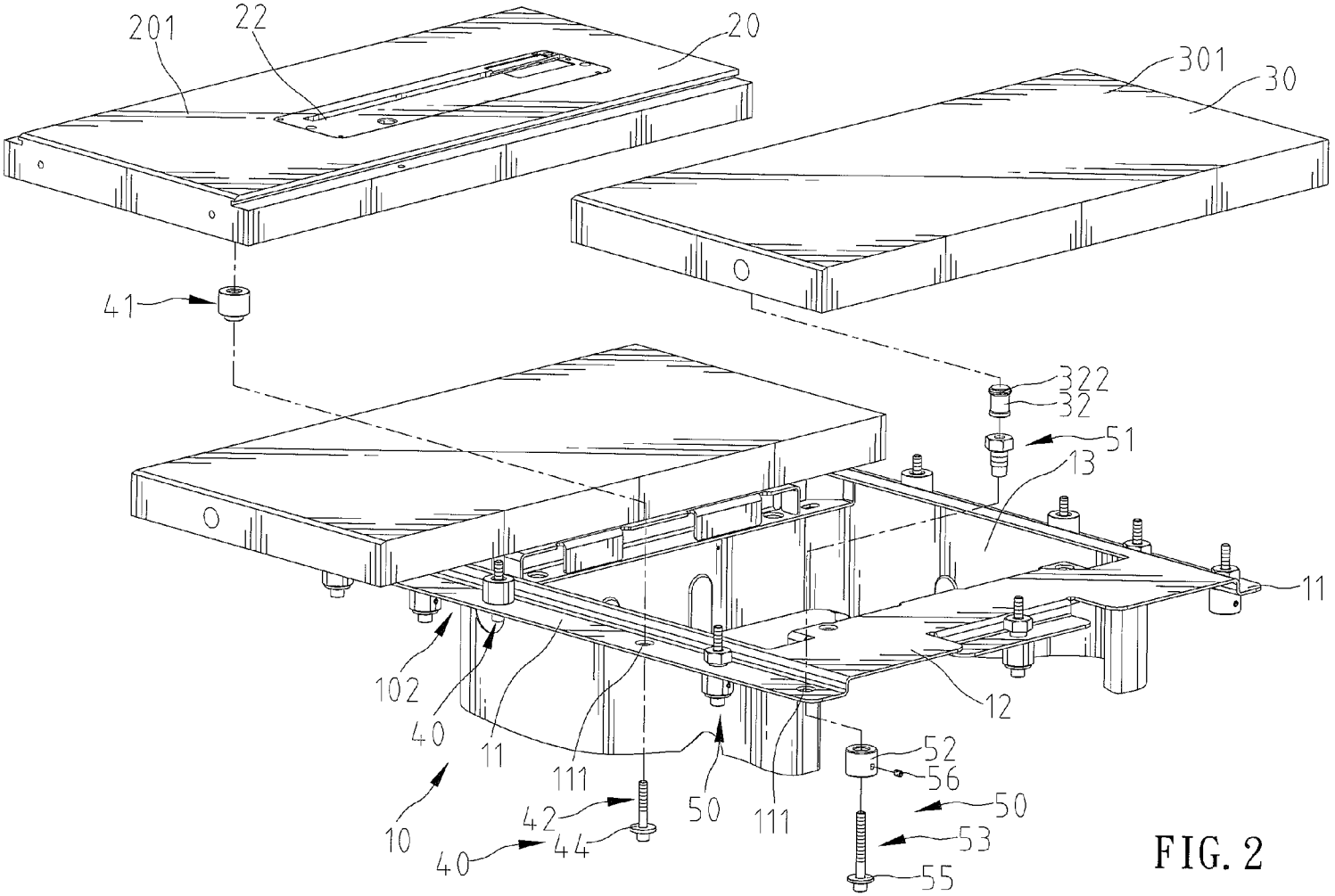
FIG. 2 is an exploded perspective view of the woodworking machine shown in FIG. 1.
Figure 3:
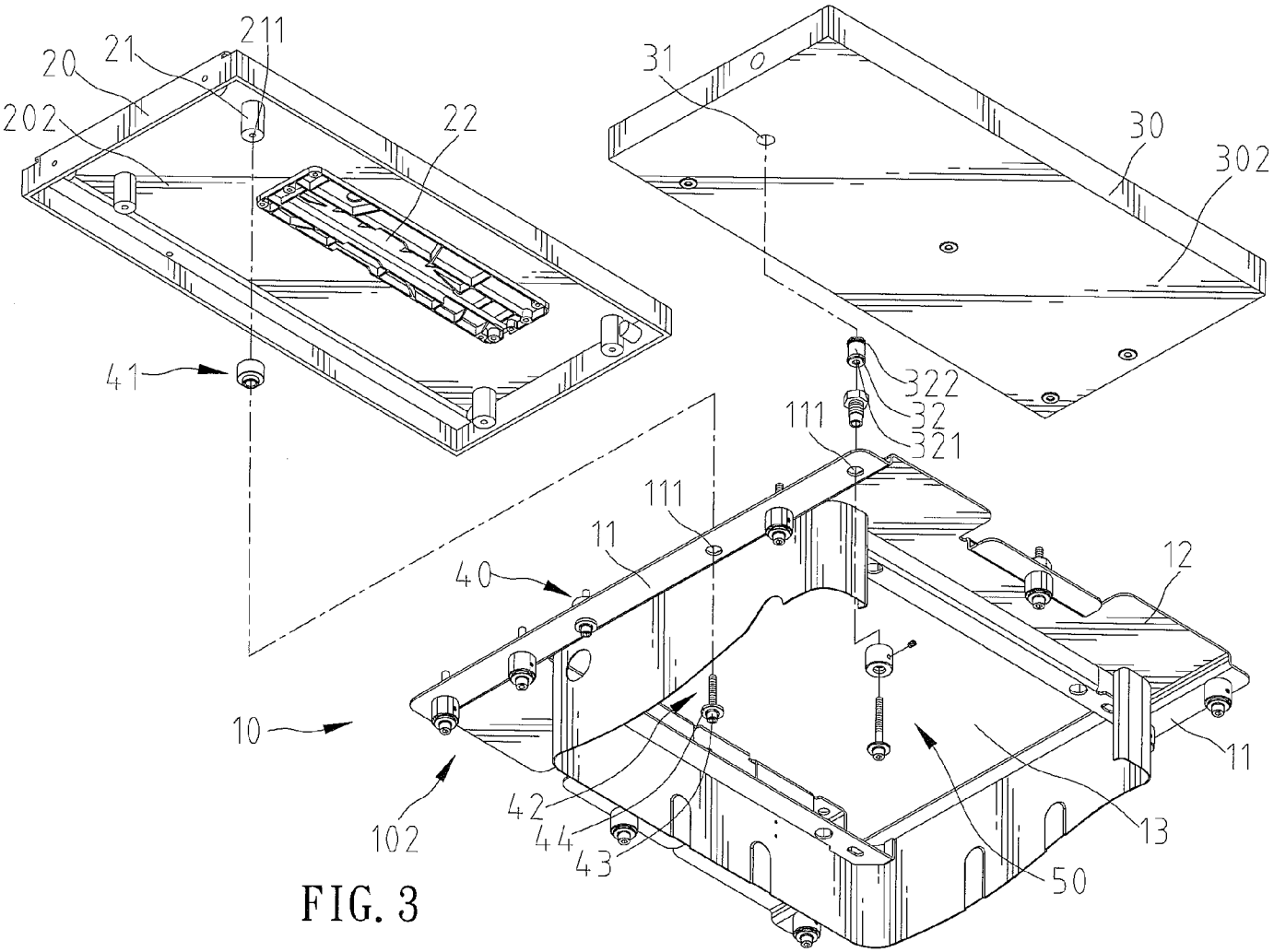
FIG. 3 is another exploded perspective view of the woodworking machine shown in FIG. 1.

FIGS. 1 through 3 show a woodworking machine in accordance with a first embodiment in the present invention. The woodworking machine includes a base member 10, a primary platform 20, at least one auxiliary platform 30, a plurality of fixture units 40 and a plurality of adjustment units 50. An amount of the auxiliary platform 30 is depended on a size of the users' needed work plane and could be one or two. In this embodiment, the woodworking machine includes two auxiliary platforms 30, and the primary platform 20 is provided between the two auxiliary platforms 30. The primary and auxiliary platforms 20, 30 are secured to the base member 10 via the fixture and adjustment units 40, 50. Further, the fixture and adjustment units 40, 50 are adapted to adjust horizontal positions of the primary and auxiliary platforms 20, 30.

Figure 4:
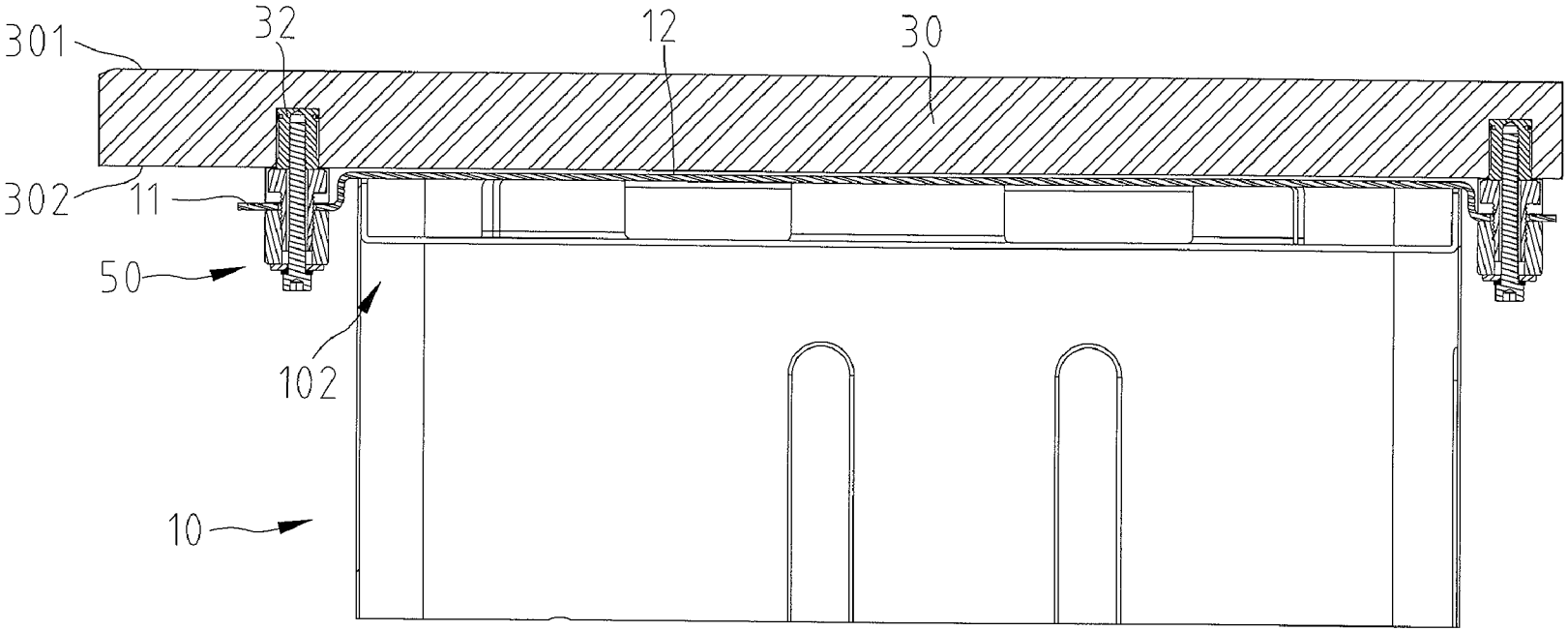
FIG. 4 is a cross-sectional view taken along line 4-4 in FIG. 1.

Referring to FIG. 4 simultaneously, the base member 10 is formed with a first section 101 standing on the ground and a second section 102 supporting the primary and auxiliary platforms 20, 30. A plurality of the coupled portions 11, an abutted portion 12 and a hollow portion 13 cause the periphery of the second section 102 of the base member 10 to be stepped, and a horizontal position of the coupled portions 11 is lower than that of the abutted portion 12. A plurality of through-holes 111 are formed on the coupled portions 11 and provided at the periphery of the second section 102 of the base member 10. The abutted portion 12 is surrounded by the coupled portions 11, and the hollow portion 13 is defined at the center of the abutted portion 12 and adapted to receive woodworking cutting tools (not shown).

Figure 5:
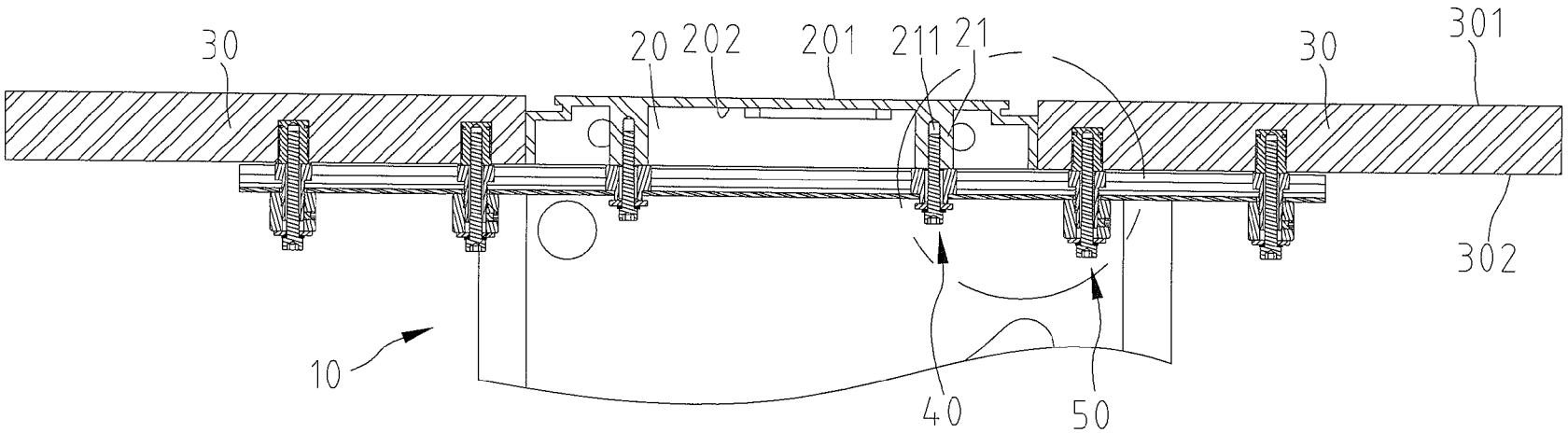
FIG. 5 is a cross-sectional view taken along line 5-5 in FIG. 1.

Referring to FIG. 5 simultaneously, the primary platform 20 corresponds to the hollow portion 13 and includes top and bottom surfaces 201, 202. Materials which are going to be processed can be put on the top surface 201, and the bottom surface 202 is installed to the second section 102 of the base member 10. A plurality of projections 21 project from the bottom surface 202 of the primary platform 20, and each projection 21 has an engaged portion 211 opposite to the bottom surface 202 of the primary platform 20. In this case, the engaged portion 211 is in the form of a threaded hole. An inserted groove 22 is formed at the center of the primary platform 20, and blades of the woodworking cutting tools can insert through the inserted groove 22 (not shown).

Figure 6:
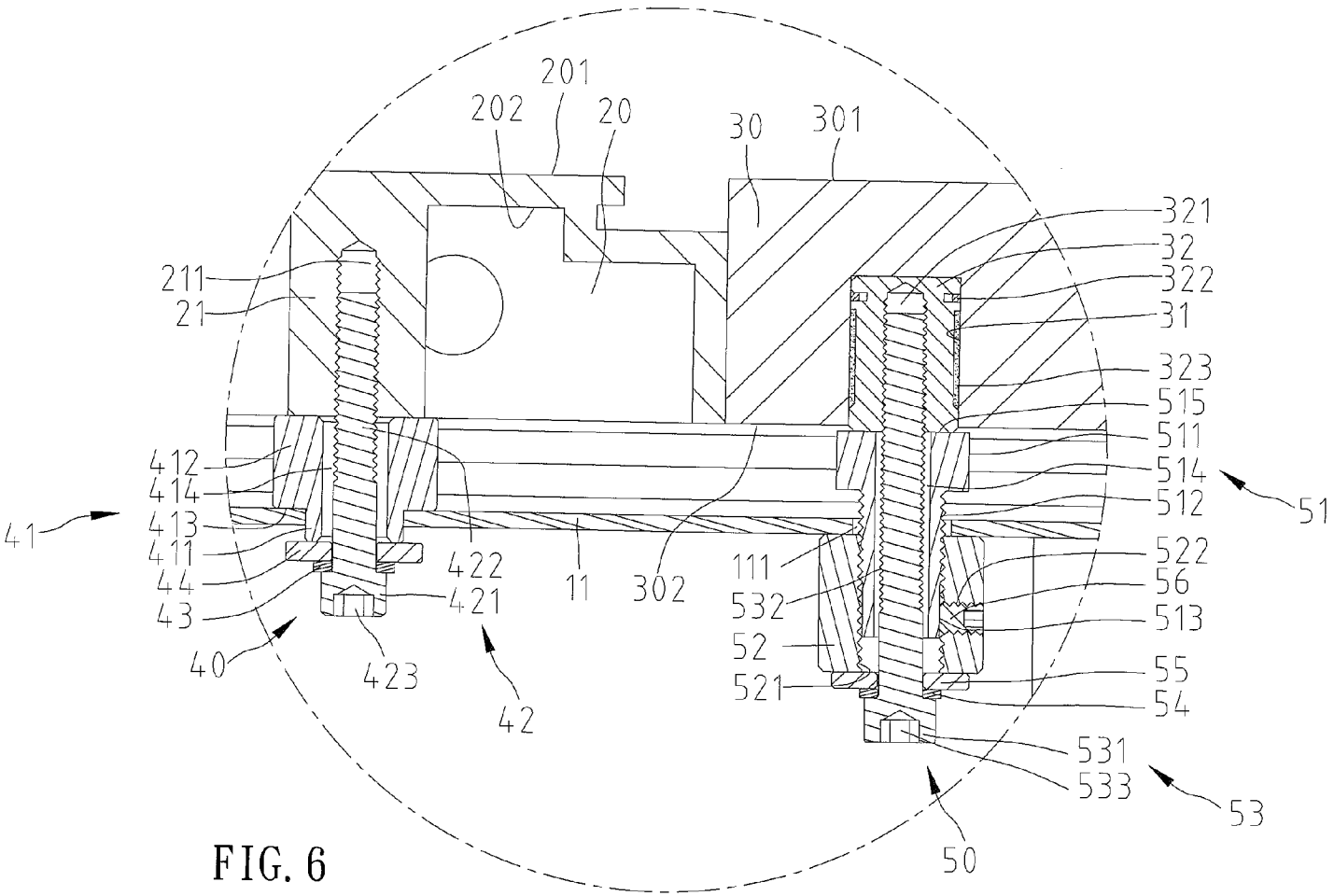
FIG. 6 is a partial, enlarged view of the woodworking machine shown in FIG. 5.

Referring to FIG. 6 simultaneously, each auxiliary platform 30, which is made of a material with better stability, acid capacity, deformation resistance and shockproof, is disposed at the second section 102 of the base member 10 and supported by the abutted portion 12. Each auxiliary platform 30 has a top surface 301 which is flat and smooth and a bottom surface 302 having a plurality of receiving holes 31 and coupled blocks 32. Each coupled block 32 is received in the related one of the receiving holes 31 and forms a coupled hole 321 axially. In this case, the coupled hole 321 is in the form of a threaded hole. A fastener 322 is surroundingly mounted on the outer periphery of each coupled block 32 and abutted against the inner wall of the related receiving hole 31. Some adhesive 323 is applied on the outer periphery of each coupled block 32 to stick the coupled blocks 32 to the receiving holes 31.

Each fixture unit 40 is used for coupling the base member 10 and the primary platform 20 and includes a spacer 41, a fixture element 42, an elastic washer 43 and a flat washer 44. The spacer 41 includes a small-diameter first end 411, a large-diameter second end 412, a blocked portion 413 formed between the first and second ends 411, 412 and a through-hole 414 formed therethrough from the first end 411 to the second end 412. The first end 411 of the spacer 41 is inserted into one of the through-holes 111 of the base member 10, the second end 412 of the spacer 41 is abutted with the primary platform 20, and the blocked portion 413 is provided at the related coupled portion 11. In this case, the fixture element 42 is in the form of a bolt and has a head 421, an engaged portion 422, and a driving portion 423 defined at the head 421. The engaged portion 422 is inserted through the elastic washer 43, the flat washer 44 and the through-hole 414 in sequence and then engaged with the engaged portion 422 of the fixture element 42. The elastic washer 43 is provided between the head 421 of the fixture element 42 and the related coupled portion 11.

Each adjustment unit 50 is used for coupling the base member 10 and the auxiliary platforms 30 and includes an adjustment element 51, a first connective element 52, a second connective element 53, an elastic washer 54, a flat washer 55 and a tightening element 56. In this case, an end of the adjustment element 51 is formed with a hexagonal operated portion 511 able to be operated by a wrench, and another end forms is formed with an adjustment portion 512. A pressed portion 513 is provided between the adjustment element 51 and the adjustment portion 512. The operated portion 511 is disposed between the base member 10 and the related auxiliary platform 30. In this case, the adjustment portion 512 preferably has outer threads and is inserted into one of the through-holes 111 of the base member 10. In this case, the pressed portion 513 is preferably flat. A through-hole 514 formed through the adjustment element 51 and an end of the operated portion 511 is formed with an abutted portion 515 which is opposite to the adjustment portion 512 and abutted with the coupled block 32 of the related auxiliary platform 30. The adjustment portion 512 and the pressed portion 513 of each adjustment unit 50 are inserted into the selected through-hole 111 of the base member 10.

The first connective element 52 of each adjustment unit 50 is provided at the selected coupled portion 11 opposite to the related auxiliary platform 30 and includes a longitudinal first connective portion 521 and a transverse second connective portion 522. The first and second connective portions 521, 522 are perpendicular to and communicate with each other. The first connective portion 521 is coupled to the related adjustment portion 512 which is outside of the related through-hole 111 of the base member 10. The second connective portion 522 is preferably in the form of a bolt and adapted to couple the first connective portion 521 and the related auxiliary platform 30.

The second connective element 53 includes a head 531, an engaged portion 532, and a driving portion 533 defined at the head 531. The engaged portion 532 is inserted through the elastic washer 54, the flat washer 55 and the through-hole 514 of the adjustment element 51 in sequence and then engaged with the coupled hole 321 of the coupled block 32. In this case, the tightening element 56 is in the form of a bolt and coupled to the second connective portion 522 of the first connective element 52 and abutted with the pressed portion 513 of the adjustment element 51.

Figure 7:
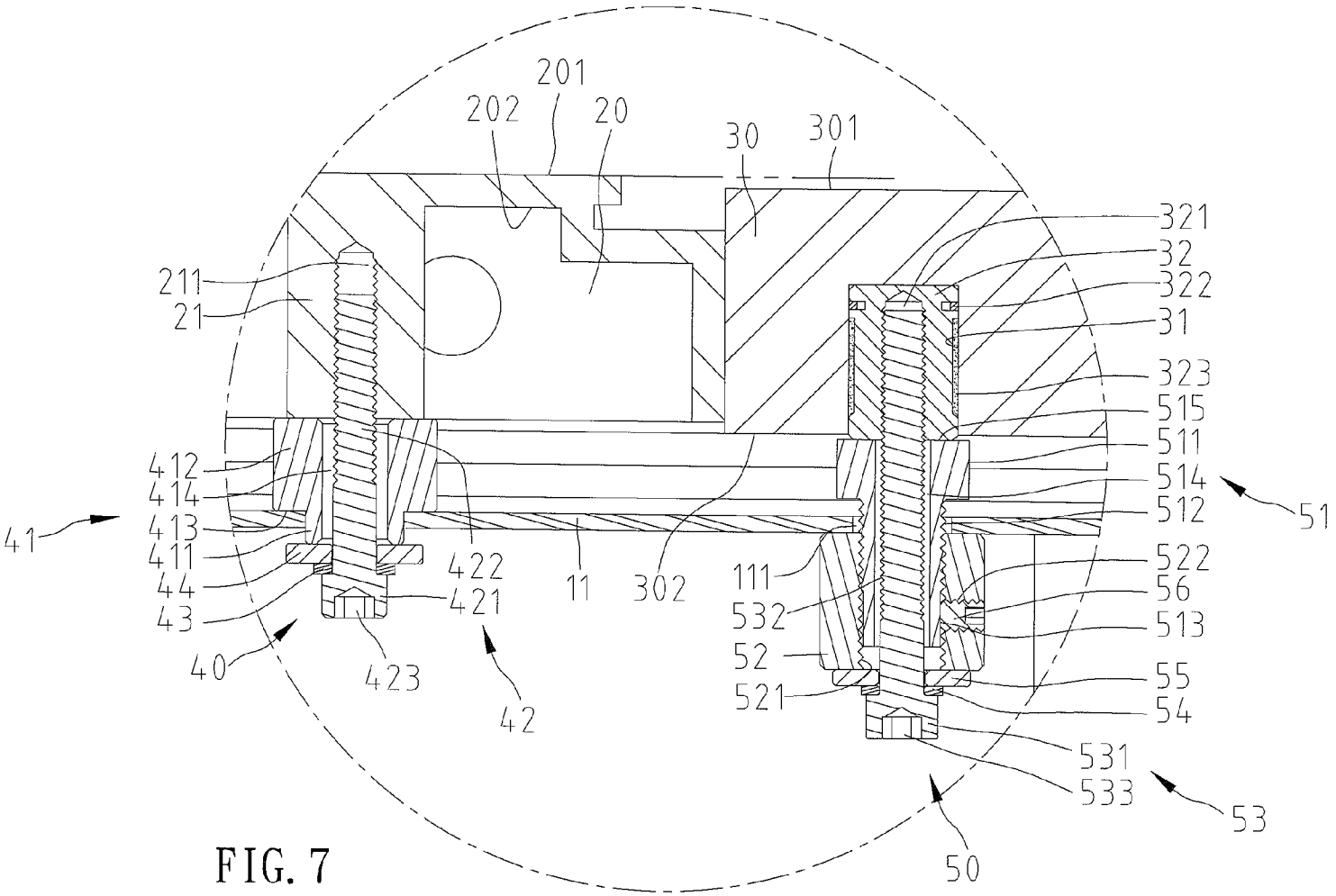
FIG. 7 is another enlarged view similar to FIG. 6, illustrating that the primary and the auxiliary platforms are not in the same horizontal position.
Figure 8:
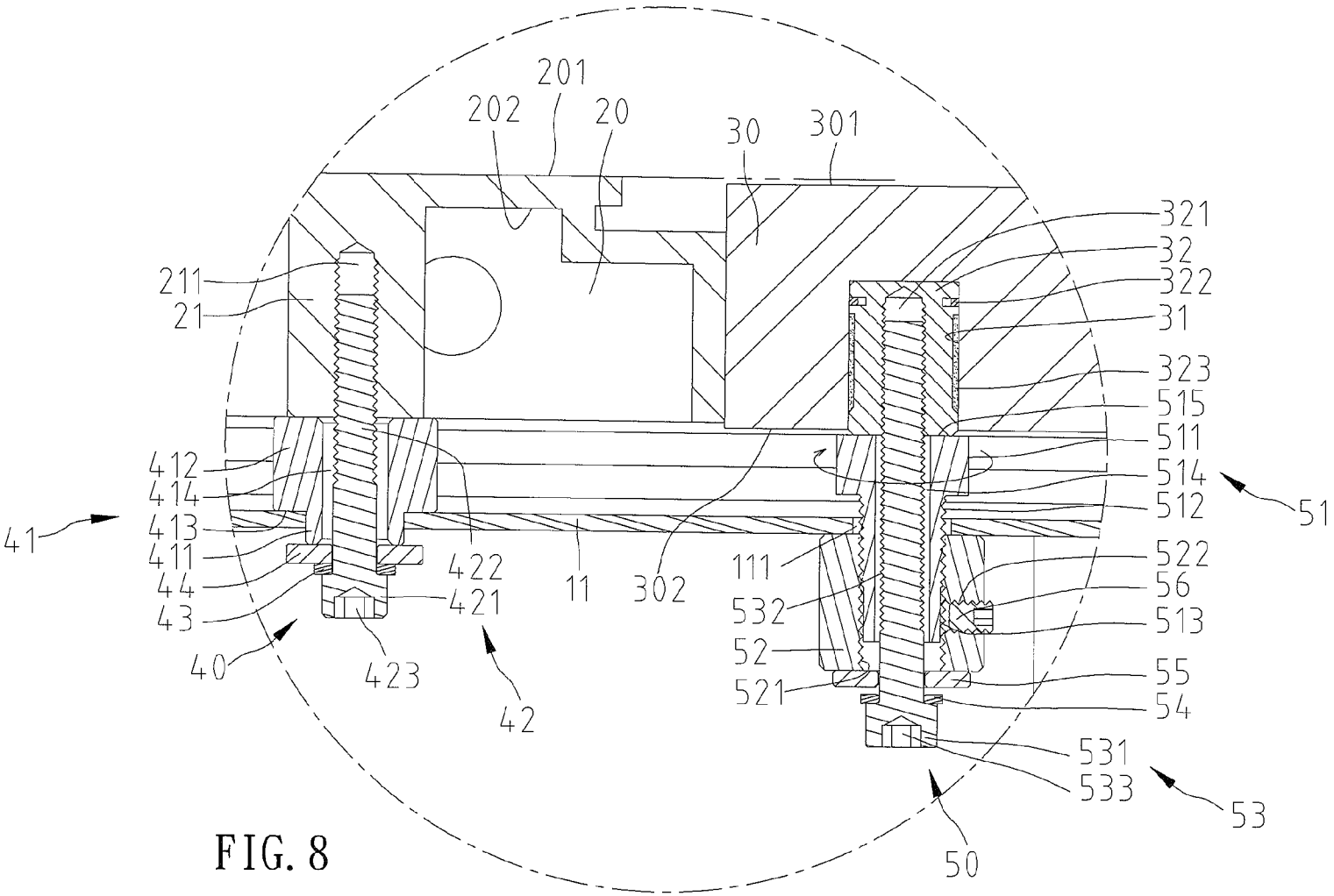
FIG. 8 is another enlarged view similar to FIG. 6, illustrating that the adjustment unit is operated to adjust a horizontal position of the auxiliary platform.
Figure 9:
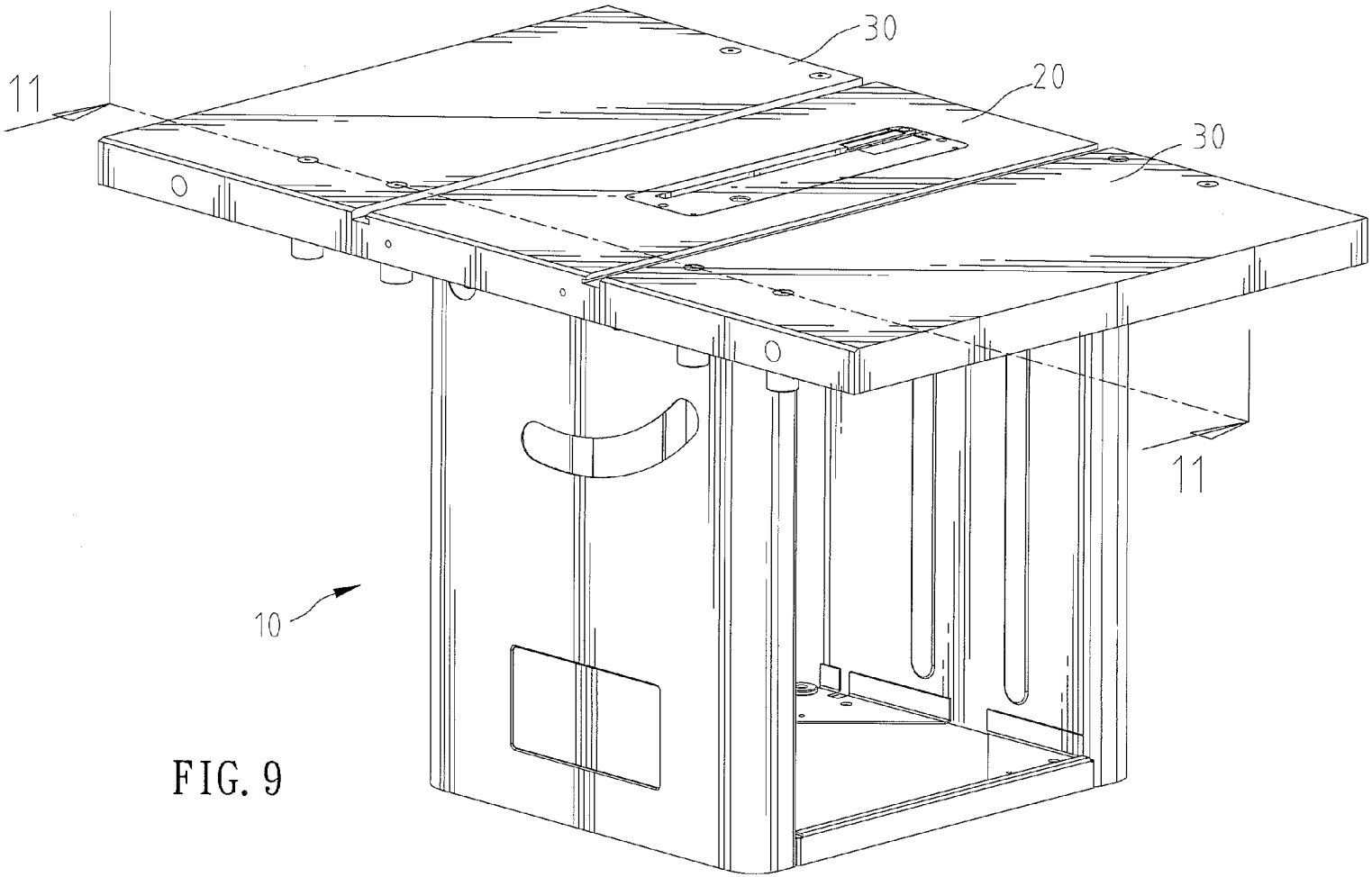
FIG. 9 is a perspective view of a woodworking machine with a horizontal positions adjustment unit according to a second embodiment of the present invention.
Figure 10:
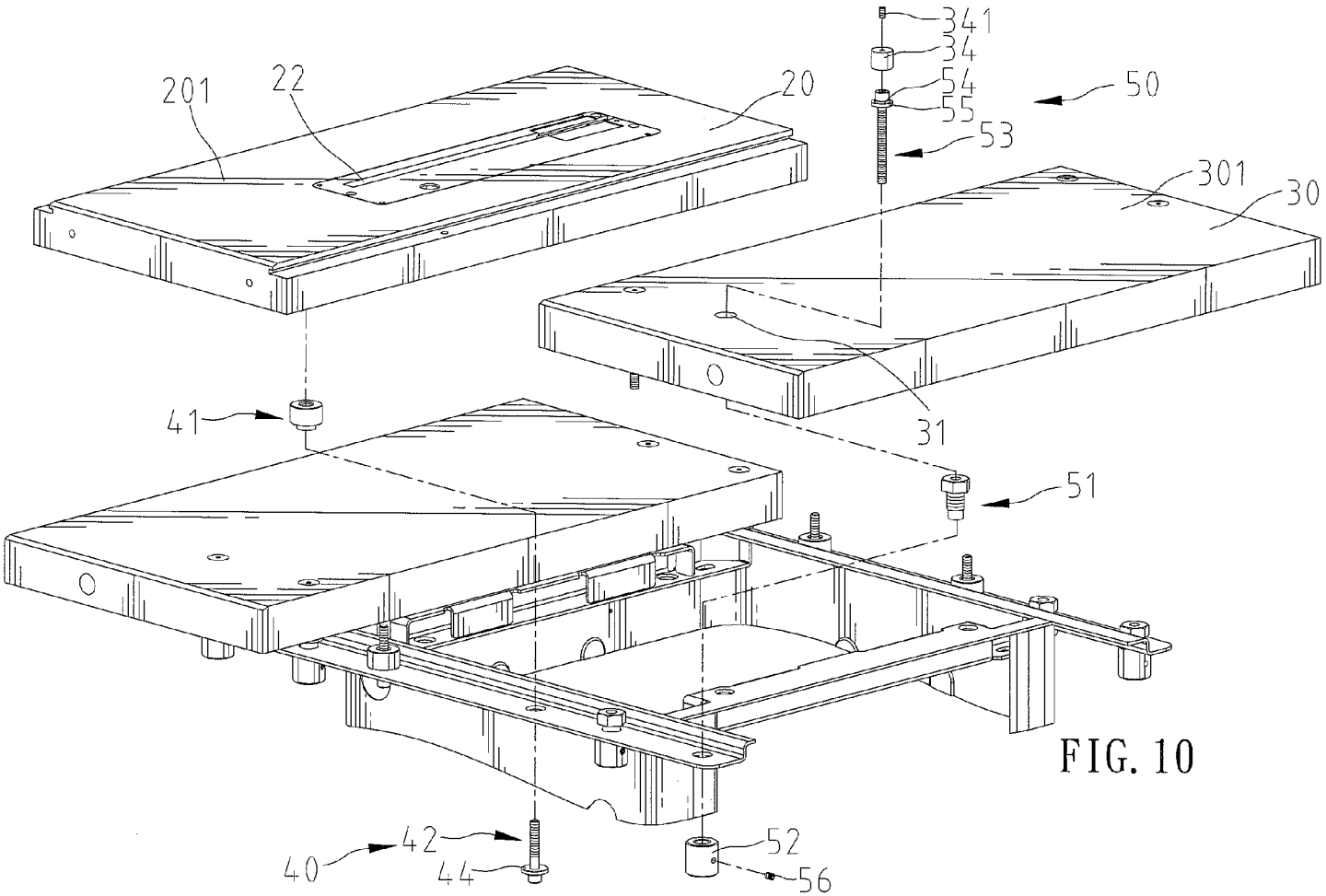
FIG. 10 is an exploded perspective view of the woodworking machine shown in FIG. 9.
Figure 11:
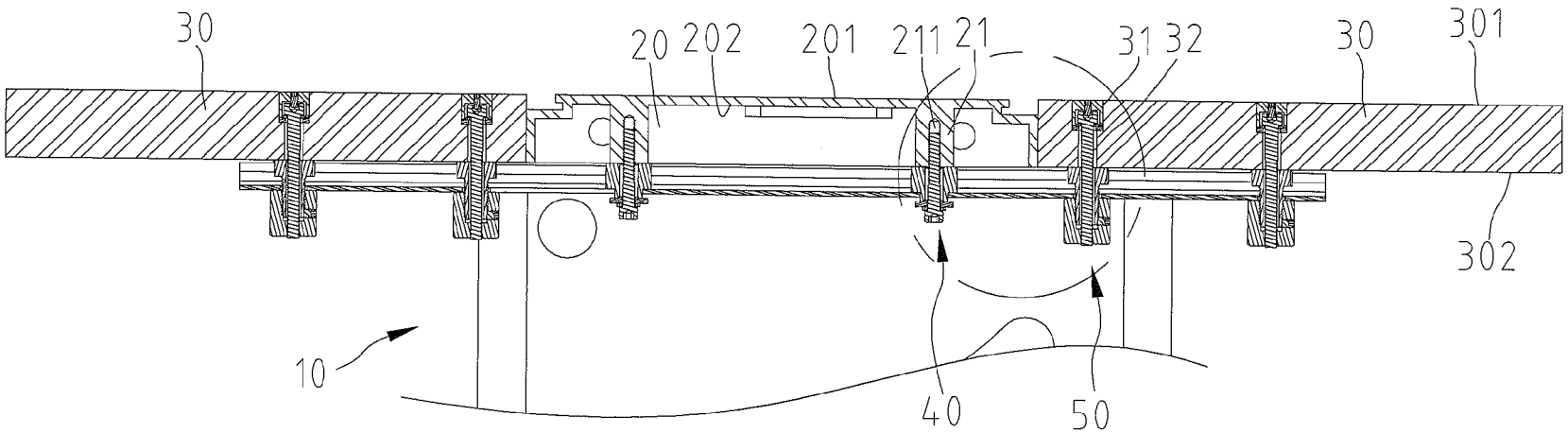
FIG. 11 is a cross-sectional view taken along line 11-11 in FIG. 9.
Figure 12:
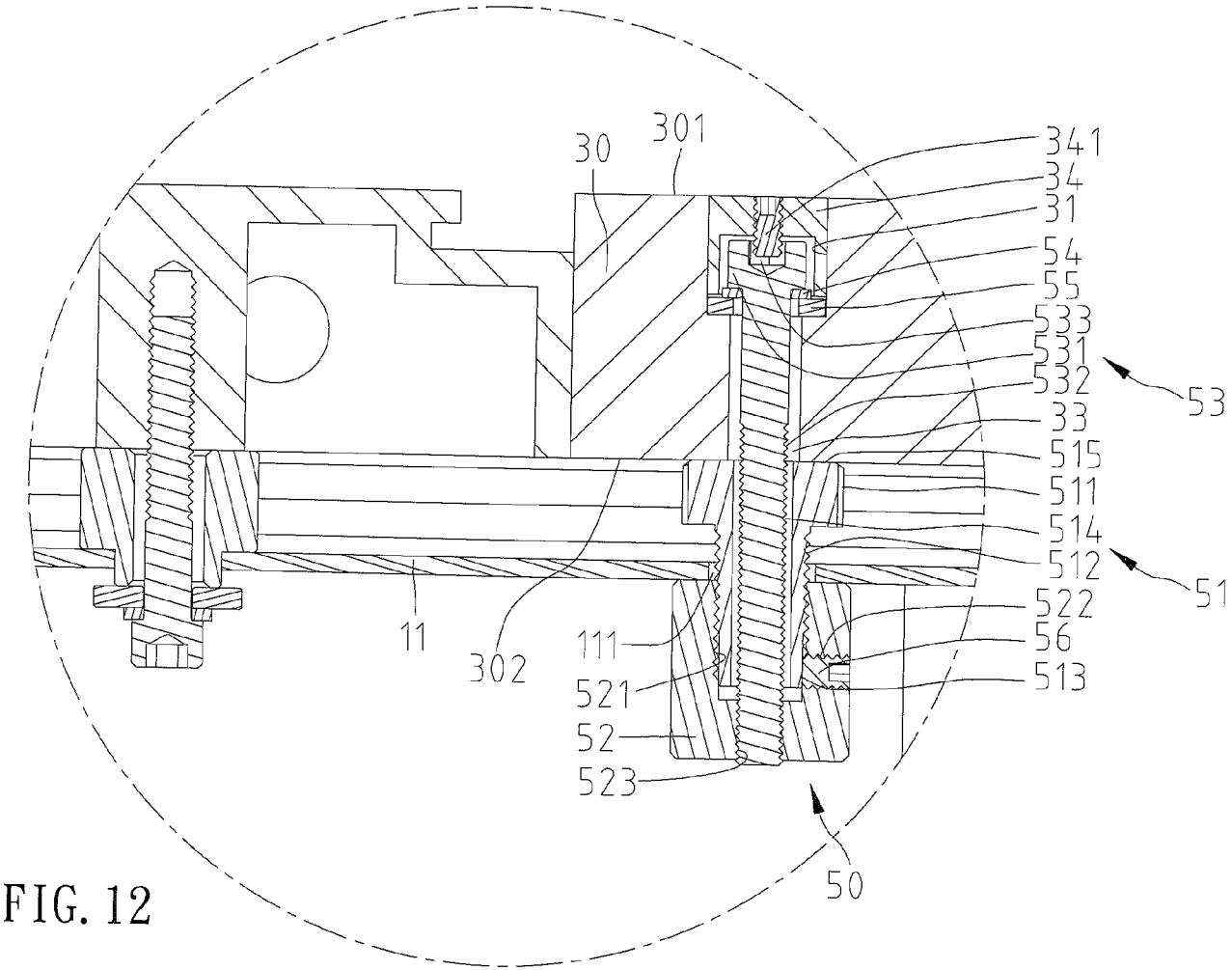
FIG. 12 is a partial, enlarged view of the woodworking machine shown in FIG. 11.

Referring to FIGS. 7 and 8, before leaving the factory, the primary platform 20 and the base member 10 are joined together in advance, and a horizontal position of the primary platform 20 has further been corrected in advance. The auxiliary platforms 30 can be added according to the users' needs of sizes of the work plane of the woodworking machine. Thus, a horizontal position of each auxiliary platform 30 can be adjusted by the users freely.

Each adjustment unit 50 is used to couple the coupled portions 11 of the base member 10 and the auxiliary platforms 30, and the abutted portion 515 of each adjustment element 51 is abutted with parts of the related coupled block 32 which are exposed from the related auxiliary platform 30. Users can operate the operated portion 511 of the selected adjustment element 51 by using hand tools to adjust the horizontal position of each auxiliary platform 30. Before adjusting the horizontal position of each auxiliary platform 30, the tightening element 56 should be loosened first, and, then, the tightening element 56 is detached from the pressed portion 513 of the adjustment element 51. In the meanwhile, the adjustment portion 512 of the adjustment element 51 can move axially with respect to the first connective portion 521 of the first connective element 52, and the abutted portion 515 of the adjustment element 51 is abutted against the coupled block 32 of the related auxiliary platform 30. Hence, adjustments of the horizontal positions of the auxiliary platforms 30 are based on the horizontal position of the primary platform 20. Finally, after finishing of the adjustment the horizontal positions of the auxiliary platforms 30, the tightening element 56 would be tightened to tighteningly abut with the pressed portion 513 of the adjustment element 51 and prevent the adjustment portion 512 of the adjustment element 51 moving axially with respect to the first connective portion 521 of the first connective element 52. Therefore, the adjustment element 51 is positioned.

Moreover, the driving portion 533 of the second connective element 53 is operated by hand tools to engage the engaged portion 532 of the second connective element 53 with the coupled hole 321 of the coupled block 32 after finishing adjustment of the horizontal positions of the auxiliary platforms 30. While the second connective element 53 is tighteningly engaged with the coupled block 32, the fastener 322 and the adhesive 323 which is applied on the outer periphery of the coupled block 32 can prevent the coupled block 32 detaching from the receiving hole 31.

FIGS. 9 through 12 show a woodworking machine in accordance with a second embodiment in the present invention similar to the first embodiment except for several features as follows. Firstly, the second connective element 53 is disposed onto the top surface 301 of the related auxiliary platform 30 to be easier to be operated by users. Secondly, a plurality of through-holes 33 is formed on the auxiliary platforms 30 and communicate with the receiving hole 31. The receiving hole 31 is proximal to the top surface 301, and the through-holes 33 are proximal to the bottom surface 302. A cap 34 is provided to close the receiving hole 31 and prevents that dust entering the receiving hole 31. A threaded element 341 is longitudinally engaged with the cap 34. Thirdly, a third connective portion 523 is further formed longitudinally on the first connective element 52 and communicates with the first connective portion 521.

Each adjustment unit 50 is used to couple the coupled portions 11 of the base member 10 and the auxiliary platforms 30. In this embodiment, the abutted portion 515 of the adjustment element 51 is abutted with the bottom surface 302 of the related auxiliary platform 30, and the adjustment portion 512 and the pressed portion 513 are inserted into the related through-hole 111 of the base member 10. The first connective portion 521 of the first connective element 52 is engaged with the adjustment portion 512 of the adjustment element 51, the second connective element 53 is engaged with the tightening element 56. The engaged portion 532 of the second connective element 53 is inserted through the elastic washer 54 and the flat washer 55. The head 531 of the second connective element 53 is disposed in the receiving hole 31, and the engaged portion 532 is inserted into the related through-hole 33 and engaged with the third connective portion 523 of the first connective element 52.

Users can operate the operated portion 511 of the selected adjustment element 51 by using hand tools to adjust the horizontal position of each auxiliary platform 30. Before adjusting the horizontal position of each auxiliary platform 30, the tightening element 56 should be loosened first, and then, the tightening element 56 is detached from the pressed portion 513 of the adjustment element 51. In the meanwhile, the adjustment portion 512 of the adjustment element 51 can move axially with respect to the first connective portion 521 of the first connective element 52, and the abutted portion 515 of the adjustment element 51 is abutted against the coupled block 32 of the related auxiliary platform 30. Hence, adjustments of the horizontal positions of the auxiliary platforms 30 are based on the horizontal position of the primary platform 20. Finally, after finishing adjustment of the horizontal positions of the auxiliary platforms 30, the tightening element 56 would be tightened to tighteningly abut with the pressed portion 513 of the adjustment element 51 and prevent that the adjustment portion 512 of the adjustment element 51 moving axially with respect to the first connective portion 521 of the first connective element 52. Therefore, the adjustment element 51 is positioned.

Moreover, the driving portion 533 of the second connective element 53 is operated by hand tools to engage the engaged portion 532 of the second connective element 53 with the third connective portion 523 of the first connective element 52 after finishing adjusting the horizontal positions of the auxiliary platforms 30. Before tighteningly engaging the second connective element 53 with the first connective element 52, the cap 34 has to be taken off from the receiving hole 31. By using hand tools, the threaded element 341 can be disengaged from the cap 34 to detach the cap 34 from the related receiving hole 31.

While several embodiments of the invention have been shown and described, it will be apparent to those skilled in the art that modifications may be made therein without departing from the scope and spirit of the present invention.

What is claimed is:

1. An adjustment unit installed to a woodworking machine, which includes a base member and an auxiliary platform, and provided between the base member and the auxiliary platform, the adjustment unit comprising:

an adjustment element including an operated portion formed on an end thereof and an adjustment portion formed on another end thereof;

a first connective element including a longitudinal first connective portion coupled to the adjustment portion of the adjustment element;

a second connective element coupled to the first connective element and driving the operated portion of the adjustment element to adjust a horizontal position of the auxiliary platform; and a tightening element and a transverse second connective portion formed on the first connective element and communicating with the first connective portion of the first connective element, with the tightening element coupled to the second connective portion and abutted with the adjustment element.

2. The adjustment unit as claimed in claim 1 further comprising a flat pressed portion provided between the adjustment element and the adjustment portion, with the tightening element abutted against the pressed portion.

3. The adjustment unit as claimed in claim 1 wherein the adjustment element includes a through-hole formed therethrough and the second connective element is inserted into the through-hole of the adjustment element.

4. An adjustment unit installed to a woodworking machine, which includes a base member and an auxiliary platform, and provided between the base member and the auxiliary platform, the adjustment unit comprising:

an adjustment element including an operated portion formed on an end thereof and an adjustment portion formed on another end thereof;

a first connective element including a longitudinal first connective portion coupled to the adjustment portion of the adjustment element;

a second connective element coupled to the first connective element and driving the operated portion of the adjustment element to adjust a horizontal position of the auxiliary platform; and a third connective portion formed longitudinally on the first connective element; wherein the second connective element has a head and an engaged portion coupled to the third connective portion of the first connective element.

5. A woodworking machine comprising:

a base member including a first section standing on the ground and a second section, with a plurality of through-holes formed on an outer periphery of the second section of the base member;

a primary platform installed to the second section of the base member;

an auxiliary platform installed to the second section of the base member; numbers of adjustment units, each adjustment unit comprising:

an adjustment element including an operated portion formed on an end thereof and provided between the base member and the auxiliary platform and an adjustment portion formed on another end thereof and inserted through one of the through-holes of the base member;

a first connective element including a longitudinal first connective portion coupled to the adjustment portion of the adjustment element;

a second connective element coupled to the first connective element and driving the operated portion of the adjustment element to adjust a horizontal position of the auxiliary platform; and a transverse second connective portion formed on the first connective element and communicating with the first connective portion of the first connective element, with each adjustment unit including a tightening element coupled to the second connective portion and abutted with the adjustment element.

6. The woodworking machine as claimed in claim 5 further comprising a flat pressed portion provided between the adjustment element and the adjustment portion, with the tightening element abutted against the pressed portion.

7. A woodworking machine comprising:

a base member including a first section standing on the ground and a second section, with a plurality of through-holes formed on an outer periphery of the second section of the base member;

a primary platform installed to the second section of the base member;

an auxiliary platform installed to the second section of the base member; numbers of adjustment units, each adjustment unit comprising:

an adjustment element including an operated portion formed on an end thereof and provided between the base member and the auxiliary platform and an adjustment portion formed on another end thereof and inserted through one of the through-holes of the base member;

a first connective element including a longitudinal first connective portion coupled to the adjustment portion of the adjustment element; and a second connective element coupled to the first connective element and driving the operated portion of the adjustment element to adjust a horizontal position of the auxiliary platform, wherein the auxiliary platform includes a plurality of coupled blocks, with each coupled block forming a coupled hole axially; wherein the adjustment element includes a through-hole formed therethrough, with the second connective element inserted through the through-hole and coupled to the coupled hole of the coupled block.

8. The woodworking machine as claimed in claim 7 wherein the auxiliary platform includes a plurality of receiving holes for receiving the plurality of coupled blocks.

9. The woodworking machine as claimed in claim 8 further comprising a fastener surroundingly mounted on the outer periphery of each coupled block and abutted against an inner wall of the related receiving hole.

10. The woodworking machine as claimed in claim 8 wherein adhesive is applied on the outer periphery of each coupled block and sticks the coupled blocks to the related receiving holes.

11. A woodworking machine comprising:

a base member including a first section standing on the ground and a second section, with a plurality of through-holes formed on an outer periphery of the second section of the base member;

a primary platform installed to the second section of the base member;

an auxiliary platform installed to the second section of the base member; numbers of adjustment units, each adjustment unit comprising:

an adjustment element including an operated portion formed on an end thereof and provided between the base member and the auxiliary platform and an adjustment portion formed on another end thereof and inserted through one of the through-holes of the base member;

a first connective element including a longitudinal first connective portion coupled to the adjustment portion of the adjustment element; and a second connective element coupled to the first connective element and driving the operated portion of the adjustment element to adjust a horizontal position of the auxiliary platform, wherein the auxiliary platform includes a plurality of receiving holes and through-holes, with each receiving hole in communication with the related through-hole; wherein the first connective element includes a longitudinal third connective portion; wherein the second connective element includes a head disposed in one of the plurality of receiving holes of the auxiliary platform and an engaged portion coupled to the third connective portion of the first connective element.

12. The woodworking machine as claimed in claim 11 further comprising a cap provided to close each receiving hole and preventing dust entering the related receiving hole.

13. The woodworking machine as claimed in claim 12 further comprising a threaded element longitudinally engaged with the cap; wherein the threaded element disengages from the cap to detach the cap from the related receiving hole.

* * * * *